US012799616B2

(12) United States Patent
Kondoh et al.

(10) Patent No.: US 12,799,616 B2
(45) Date of Patent: Nov. 17, 2026

(54) FILM FORMING METHOD FOR FORMING METAL FILM

(71) Applicant: TOYOTA JIDOSHA KABUSHIKI KAISHA, Toyota (JP)

(72) Inventors: Haruki Kondoh, Okazaki (JP); Keiji Kuroda, Toyota (JP); Koji Inagaki, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 607 days.

(21) Appl. No.: 18/238,565

(22) Filed: Aug. 28, 2023

(65) Prior Publication Data

US 2024/0133068 A1 Apr. 25, 2024
US 2024/0229278 A9 Jul. 11, 2024

(30) Foreign Application Priority Data

Oct. 25, 2022 (JP) ..... 2022-170683

(51) Int. Cl.
*C25D 5/02* (2006.01)
*C25D 17/08* (2006.01)

(52) U.S. Cl.
CPC ..... *C25D 5/022* (2013.01); *C25D 17/08* (2013.01)

(58) Field of Classification Search
None
See application file for complete search history.

(56) References Cited

U.S. PATENT DOCUMENTS

2002/0166468 A1 11/2002 Schmid et al.
2016/0160378 A1 6/2016 Sato et al.
2016/0186354 A1 6/2016 Hiraoka et al.

FOREIGN PATENT DOCUMENTS

JP 2002-356075 A 12/2002
JP 2013-166999 A 8/2013
JP 2016-108586 A 6/2016
JP 2016-125087 A 7/2016
JP 2022091406 A * 6/2022
JP 2023-148994 A 10/2023

* cited by examiner

*Primary Examiner* — Louis J Rufo
(74) *Attorney, Agent, or Firm* — Oliff PLC

(57) ABSTRACT

The method includes: placing a substrate on a mount base; covering the substrate with the screen mask including a penetrating portion of a predetermined pattern; pressing the substrate by the electrolyte membrane with a fluid pressure of a plating solution contacting the electrolyte membrane via the screen mask; and applying a voltage between an anode contacting the plating solution and the substrate so as to allow metal ions contained in the plating solution to pass through the electrolyte membrane and form a metal film derived from the metal ions in the predetermined pattern on the substrate. The substrate includes an outer edge portion formed by an opposite surface facing the screen mask and a side surface. A cushion member is disposed along the outer edge portion before pressing the substrate.

5 Claims, 9 Drawing Sheets

FILM FORMING METHOD FOR FORMING METAL FILM

CROSS REFERENCE TO RELATED APPLICATIONS

The present application claims priority from Japanese patent application JP 2022-170683 filed on Oct. 25, 2022, the entire content of which is hereby incorporated by reference into this application.

BACKGROUND

Technical Field

The present disclosure relates to a film forming method for forming a metal film in a predetermined pattern on a surface of a substrate.

Background Art

Conventionally, a metal film is formed by depositing metal on the surface of a substrate by electroplating (for example, JP 2016-125087 A). In JP 2016-125087 A, the film forming apparatus includes a housing containing a plating solution. The housing has an opening that is sealed with an electrolyte membrane. The film forming apparatus further includes a pressing mechanism that presses the substrate by the electrolyte membrane with a fluid pressure of the plating solution.

Here, when a metallic underlayer having a predetermined pattern is formed on the surface of the substrate, the film forming apparatus applies a voltage between the anode and the substrate while pressing the substrate with the fluid pressure of the electrolyte membrane. Thus, the film forming apparatus can form a metal film having the predetermined pattern on the underlayer. However, when an underlayer of the predetermined pattern is not formed on the substrate, it is also conceivable to use, for example, a masking material disclosed in JP 2016-108586 A.

SUMMARY

Here, when a film is formed using a screen mask as the masking material, the screen mask is sandwiched between the substrate and the electrolyte membrane. In this condition, in order to ensure the adhesion between the substrate and the screen mask, the screen mask is pressed by the electrolyte membrane on which the fluid pressure of the plating solution is acting. However, the substrate includes an outer edge portion formed by an opposite surface facing the screen mask and a side surface. This may cause damage to the screen mask when pressed against the outer edge portion of the substrate.

The present disclosure has been made in view of the foregoing, and provides a film forming method for forming a metal film capable of, even when a screen mask is used, suppressing damage to the screen mask when pressed by the electrolyte membrane.

In view of the foregoing, the film forming method for forming a metal film according to the present disclosure is a film forming method, including: placing a substrate on a mount base; covering the substrate with a screen mask including a penetrating portion of a predetermined pattern; pressing the substrate by an electrolyte membrane with a fluid pressure of a plating solution contacting the electrolyte membrane via the screen mask; and applying a voltage between an anode contacting the plating solution and the substrate so as to allow metal ions contained in the plating solution to pass through the electrolyte membrane and form a metal film derived from the metal ions in the predetermined pattern on the substrate. The substrate includes an outer edge portion formed by an opposite surface facing the screen mask and a side surface. A cushion member is disposed along the outer edge portion before pressing the substrate.

According to the present disclosure, the cushion member is disposed along the outer edge portion of the substrate before pressing the substrate. Thus, when the substrate is pressed by the electrolyte membrane with the fluid pressure of the plating solution via the screen mask, the outer edge portion of the substrate is pressed by the screen mask via the cushion member. Consequently, damage to the screen mask can be suppressed by the outer edge portion of the substrate.

In one example of the present disclosure, in placing the substrate, the substrate may be housed in a recess of the mount base, the recess being formed for housing the substrate, and in disposing the cushion member, the cushion member may cover a gap formed between the side surface of the substrate and a side wall surface of the recess.

A gap may be formed between the substrate and the mount base with the substrate housed in the recess. With this gap formed, the screen mask easily enters the gap when the electrolyte membrane presses the substrate via the screen mask. Consequently, the screen mask contacts the opening edge of the recess, and the screen mask is easily damaged. In this example, by covering the gap with the cushion member, it is possible to prevent the screen mask from entering the gap. Consequently, damage to the screen mask can be suppressed.

In one example of the present disclosure, the cushion member may be attached to the screen mask, and in covering the substrate with the screen mask, the cushion member may cover the gap.

According to this example, since the cushion member is attached to the screen mask in advance, it is possible to prevent misalignment of the cushion member with respect to the screen mask. Furthermore, in covering the substrate with the screen mask, the cushion member can cover the gap at the same time.

In one example of the present disclosure, before placing the substrate, the cushion member may be attached to the substrate along the outer edge portion.

According to this example, the substrate can be placed on the mount base with the cushion member attached to the substrate. Therefore, when the substrate is placed, the cushion member can be disposed at the same time to prevent misalignment of the cushion member with respect to the substrate.

In one example of the present disclosure, the mount base includes the recess for housing the substrate, the cushion member may cover the side surface of the substrate by attaching the cushion member to the substrate, and in placing the substrate, the substrate may be housed in the recess while sandwiching the cushion member between the side wall surface of the recess and the side surface of the substrate.

According to this example, the substrate is housed in the recess of the mount base. At this time, the cushion member is sandwiched between the side surface of the substrate and the side wall surface of the mount base. This can suppress formation of a gap therebetween. Consequently, it is possible to prevent the screen mask from being damaged due to the gap between the substrate and the mount base. Furthermore, it is possible to prevent misalignment of the substrate with respect to the mount base.

In one example of the present disclosure, the mount base includes the recess for housing the substrate, the cushion member is attached to the side wall surface of the recess, and in placing the substrate, the substrate may be housed in the recess while sandwiching the cushion member between the side wall surface of the recess and the side surface of the substrate.

According to this example, the substrate is housed in the recess of the mount base. At this time, the cushion member is sandwiched between the side surface of the substrate and the side wall surface of the mount base. This can suppress formation of a gap therebetween. Consequently, it is possible to prevent the screen mask from being damaged due to the gap between the substrate and the mount base and to prevent misalignment of the substrate with respect to the mount base.

In one example of the present disclosure, a peripheral edge of the screen mask is fixed to a frame on a side adjacent to the electrolyte membrane, and in the frame, the screen mask may cover the substrate.

According to this example, the screen mask is supported by the frame on the side adjacent to the electrolyte membrane. Therefore, the screen mask can be pressed by the electrolyte membrane while suppressing deformation of the electrolyte membrane due to the fluid pressure of the plating solution. Furthermore, in the frame, since the screen mask covers the substrate, deformation of the screen mask caused by the pressure from the electrolyte membrane can be suppressed.

According to the present disclosure, even when the screen mask is used, it is possible to suppress damage to the screen mask when pressed by the electrolyte membrane.

DETAILED DESCRIPTION

Figure 1:
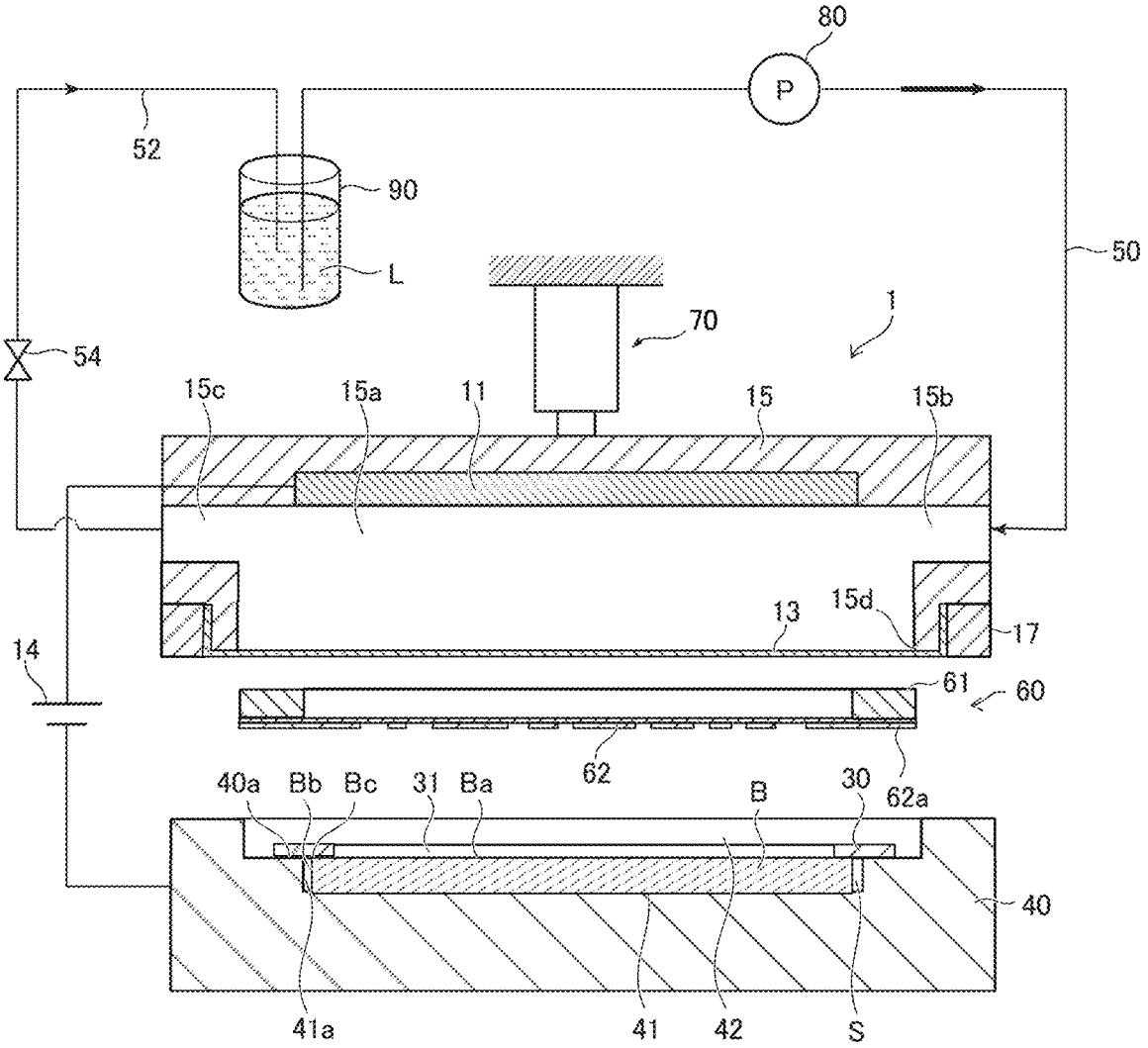
FIG. 1 is a schematic cross-sectional view illustrating an example of a film forming apparatus for forming a metal film according to an embodiment of the present disclosure.

First, a film forming apparatus 1 used in a film forming method for forming a metal film according to an embodiment of the present disclosure will be described. FIG. 1 is a schematic cross-section view illustrating an example of the film forming apparatus for forming a metal film according to an embodiment of the present disclosure.

As shown in FIG. 1, the film forming apparatus 1 is a film forming apparatus for forming a metal film F having a predetermined pattern P on a substrate B by electroplating. At the time of film formation, a mask structure 60 is sandwiched between an electrolyte membrane 13 and the substrate B. Specifically, the film forming apparatus 1 includes an anode 11, the electrolyte membrane 13, and a power supply 14 that applies a voltage between the anode 11 and the substrate B.

The film forming apparatus 1 includes a housing 15 containing the anode 11 and a plating solution L, a mount base 40 on which the substrate B is placed, and the mask structure 60. At the time of film formation, the mask structure 60 is placed on the mount base 40 together with the substrate B. The electrolyte membrane 13 is disposed between the mask structure 60 and the anode 11.

The film forming apparatus 1 includes a linear motion actuator 70 for raising and lowering the housing 15. In the present embodiment, for convenience of explanation, the electrolyte membrane 13 is disposed below the anode 11, and the mask structure 60 and the substrate B are further disposed below the electrolyte membrane 13. However, the positional relation is not limited to this as long as the metal film F can be formed on the surface of the substrate B.

The substrate B functions as a cathode. The substrate B is a plate-shaped substrate. In the present embodiment, the substrate B is a rectangular substrate. The substrate B has an opposite surface Ba facing the electrolyte membrane 13 (a screen mask 62) to serve as a film forming surface that functions as a cathode. The substrate B has a side surface Bb formed on an outer periphery thereof. The material of the substrate B is not particularly limited as long as the substrate B functions as a cathode (i.e., a conductive surface). Examples of the material of the substrate B may include a metal material such as aluminum or copper. When forming a wiring pattern using the metal film F, for the substrate B, a substrate having an underlayer of copper or the like formed on the surface of the insulating substrate made of a resin or the like may be used. In this case, after the metal film F is formed, the underlayer other than the portion on which the metal film F is formed is removed by etching or the like. In this way, a wiring pattern using the metal film F can be formed on the surface of the insulating substrate.

In one example, the anode 11 is a non-porous anode made of the same metal as the metal of the metal film. The anode 11 has a block shape or a flat plate shape. Examples of the material of the anode 11 may include copper or the like. The anode 11 dissolves when a voltage is applied by the power supply 14. However, when a film is formed using only metal ions of the plating solution L, the anode 11 is an anode insoluble in the plating solution L. The anode 11 is electrically connected to the positive electrode of the power supply 14. The negative electrode of the power supply 14 is electrically connected to the substrate B via the mount base 40.

The plating solution L is a liquid containing the metal of the metal film to be formed in the state of ions. Examples of the metal may include copper, nickel, gold, silver, iron, or the like. The plating solution L is a solution obtained by dissolving (ionizing) these metals with an acid such as nitric acid, phosphoric acid, succinic acid, sulfuric acid, or pyrophosphoric acid. Examples of the solvent of the solution may include water and alcohol. For example, when the metal is copper, examples of the plating solution L may include an aqueous solution containing copper sulfate, copper pyrophosphate, or the like.

The electrolyte membrane 13 is a membrane that can be impregnated with metal ions (i.e., can contain metal ions therein) together with the plating solution L when brought into contact with the plating solution L. The electrolyte membrane 13 is a flexible membrane. The material of the electrolyte membrane 13 is not particularly limited as long as metal ions of the plating solution L can move toward the substrate B when the power supply 14 applies a voltage. Examples of the material of the electrolyte membrane 13 may include a resin having an ion-exchange function such as a fluorine-based resin such as Nafion (registered trademark) available from DuPont. The film thickness of the electrolyte membrane 13 may be in the range of 20 μm to 200 μm. Specifically, the film thickness may be in the range of 20 μm to 60 μm.

The housing 15 is made of a material insoluble in the plating solution L. The housing 15 includes a storage space 15*a* for storing the plating solution L. The anode 11 is disposed in the storage space 15*a* of the housing 15. The storage space 15*a* includes an opening 15*d* on the side adjacent to the substrate B. The opening 15*d* of the housing 15 is covered with the electrolyte membrane 13. Specifically, the peripheral edge of the electrolyte membrane 13 is sandwiched between the housing 15 and a frame 17. Accordingly, the plating solution L in the storage space 15*a* can be sealed with the electrolyte membrane 13.

Figure 4:
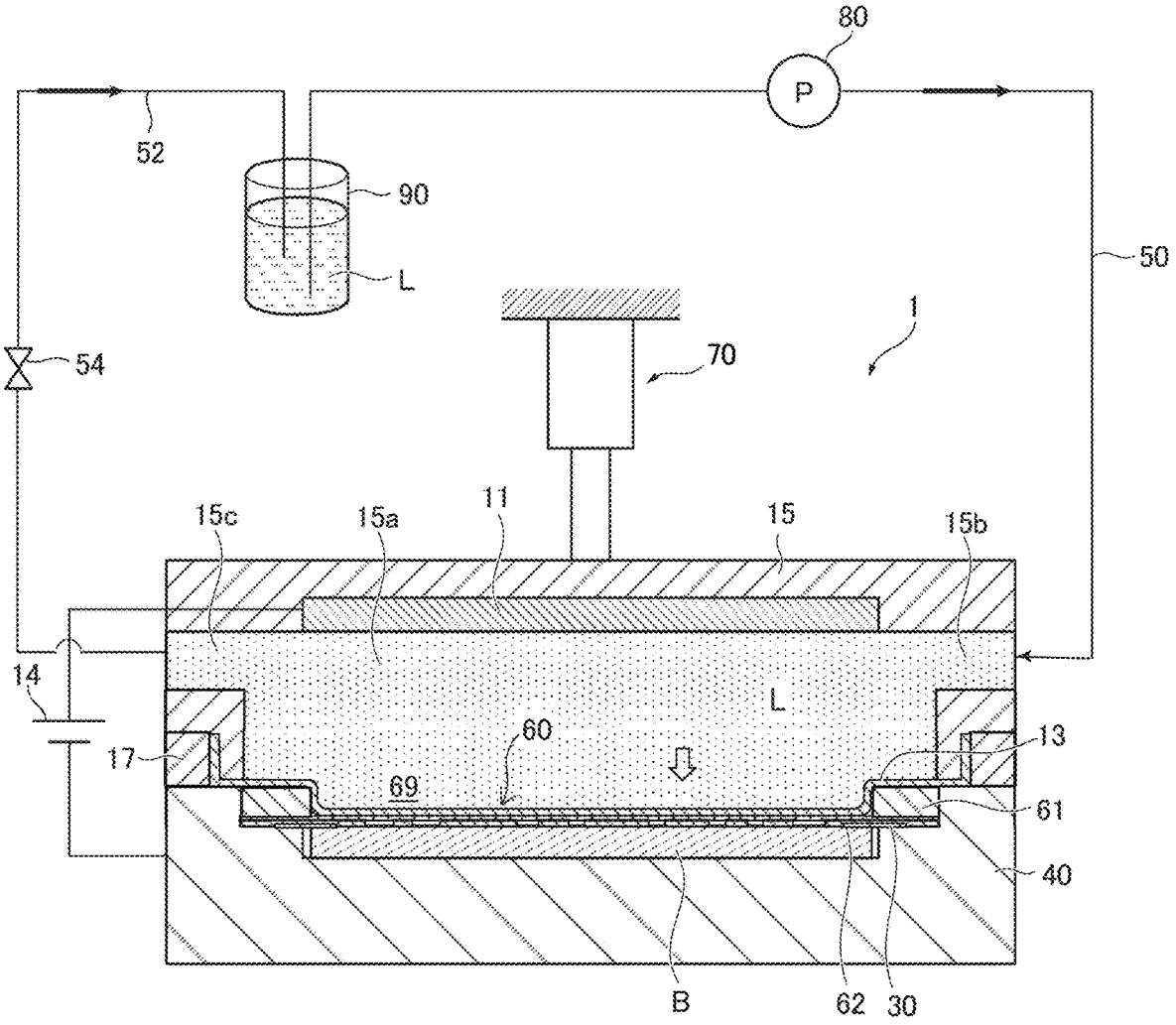
FIG. 4 is a schematic cross-sectional view for explaining the film formation by the film forming apparatus shown in FIG. 1.

As shown in FIGS. 1 and 4, the linear motion actuator 70 raises and lowers the housing 15 such that the electrolyte membrane 13 and the mask structure 60 can be brought into contact with and separated from each other. In the present embodiment, the mount base 40 is fixed, and the housing 15 is moved up and down by the linear motion actuator 70. The linear motion actuator 70 is an electric actuator, and converts the rotational motion of the motor into a linear motion by a ball screw or the like (not shown). However, instead of an electric actuator, a hydraulic or pneumatic actuator may be used.

The housing 15 includes a supply port 15*b* for supplying the plating solution L to the storage space 15*a*. Further, the housing 15 includes a discharge port 15*c* for discharging the plating solution L from the storage space 15*a*. The supply port 15*b* and the discharge port 15*c* are holes communicating with the storage space 15*a*. The supply port 15*b* and the discharge port 15*c* are formed with the storage space 15*a* interposed therebetween. The supply port 15*b* is connected to a liquid supply pipe 50. The discharge port 15*c* is fluidly connected to a liquid discharge pipe 52.

The film forming apparatus 1 further includes a liquid tank 90, the liquid supply pipe 50, the liquid discharge pipe 52, and a pump 80. As shown in FIG. 1, the liquid tank 90 contains the plating solution L. The liquid supply pipe 50 connects the liquid tank 90 and the housing 15. The liquid supply pipe 50 is provided with the pump 80. The pump 80 supplies the plating solution L from the liquid tank 90 to the housing 15. The liquid discharge pipe 52 connects the liquid tank 90 and the housing 15. The liquid discharge pipe 52 is provided with a pressure regulating valve 54. The pressure regulating valve 54 regulates the pressure (fluid pressure) of the plating solution L in the storage space 15*a* to a predetermined pressure.

In the present embodiment, by driving the pump 80, the plating solution L is sucked from the liquid tank 90 into the liquid supply pipe 50. The sucked plating solution L is pressure-fed from the supply port 15*b* to the storage space 15*a*. The plating solution L in the storage space 15*a* is returned to the liquid tank 90 via the discharge port 15*c*. In this way, the plating solution L circulates in the film forming apparatus 1.

Further, by continuing the driving of the pump 80, the fluid pressure of the plating solution L in the storage space 15*a* can be maintained at a predetermined pressure by the pressure regulating valve 54. The pump 80 is for pressing the mask structure 60 by the electrolyte membrane 13 on which the fluid pressure of the plating solution L is acting. However, the pressing mechanism is not particularly limited as long as the mask structure 60 can be pressed by the electrolyte membrane 13. Instead of the pump 80, an injection device composed of a piston and a cylinder for injecting the plating solution L may be used.

In one example, the mount base 40 is made of a conductive material (e.g., metal). The mount base 40 includes a first recess 41 and a second recess 42. The first recess 41 is a recess that houses the substrate B. The second recess 42 is a recess for housing the mask structure 60 while the substrate B is housed in the first recess 41. In the present disclosure, the "recess" corresponds to the first recess 41.

Figure 2:
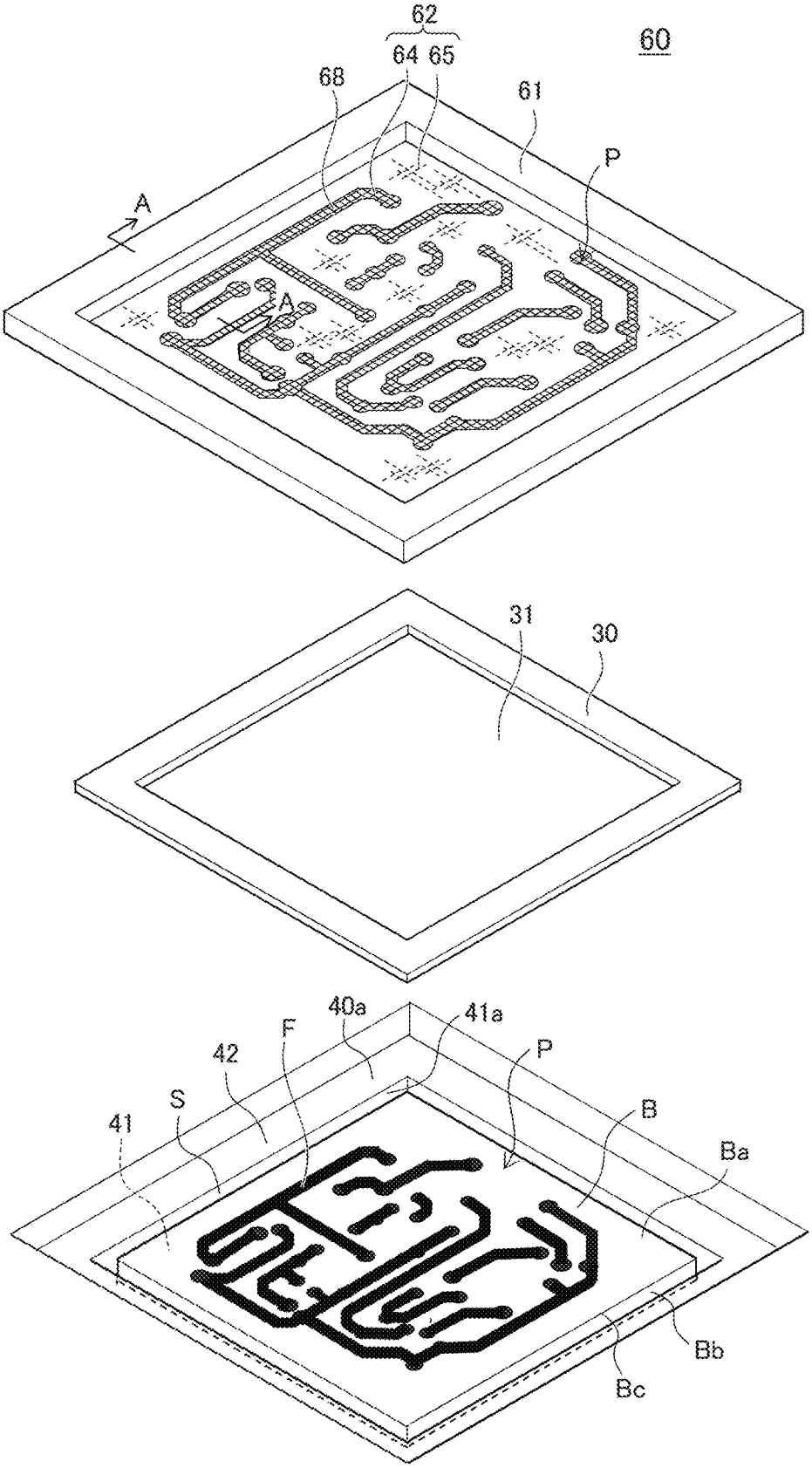
FIG. 2 is a schematic perspective view showing the arrangement of a mask structure, a cushion member, and a substrate on which a metal film is formed in the film forming apparatus shown in FIG. 1.
Figure 3A:
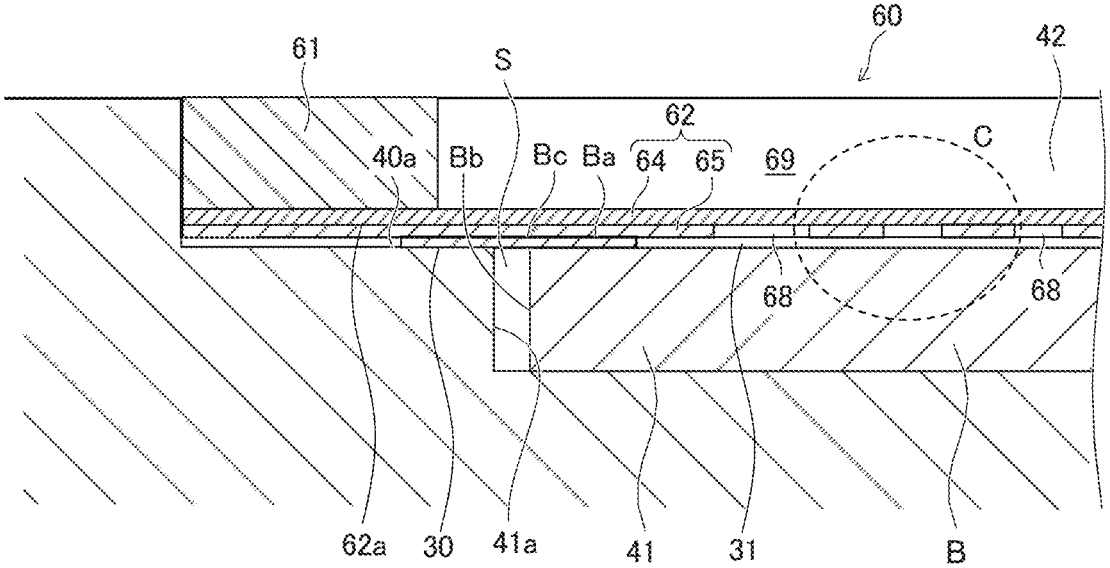
FIG. 3A is a partially enlarged cross-sectional view taken along line A-A shown in FIG. 2.
Figure 3B:
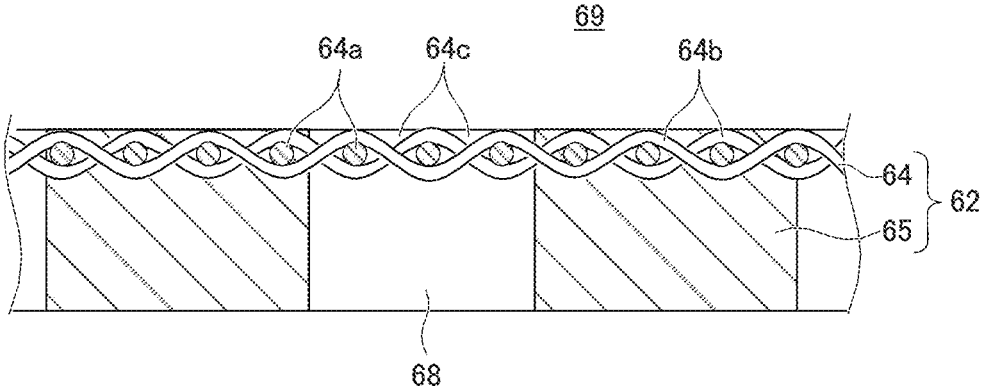
FIG. 3B is an enlarged cross-sectional view of a portion C of FIG. 3A.

FIG. 2 is a schematic perspective view of the mask structure 60 of the film forming apparatus 1 shown in FIG. 1, and a schematic perspective view of the cushion member 30 and the substrate B on which the metal film F is formed. FIG. 3A is a partially enlarged cross-sectional view taken along line A-A of FIG. 2, and FIG. 3B is an enlarged cross-sectional view of the portion C of FIG. 3A.

The mask structure 60 includes a frame 61 and a screen mask 62. The screen mask 62 includes a penetrating portion 68 corresponding to the predetermined pattern P of the metal film F. The screen mask 62 includes a mesh portion 64 and a mask portion 65. The screen mask 62 is a flexible mask of about 50 μm to 400 μm in thickness. The screen mask 62 is supported by the frame 61 on the side adjacent to the substrate B.

The mesh portion 64 is fixed to the frame 61. The mesh portion 64 is stretched at a predetermined tension so as to cover the opening of the frame 61. The mesh portion 64 includes a plurality of openings 64*c* in a grid pattern. Specifically, as shown in FIG. 3B, the mesh portion 64 is a portion in which pluralities of oriented wires 64*a*, 64*b* are woven so as to cross each other. The plurality of wires 64*a* are arranged at intervals, and the plurality of wires 64*b* intersecting the plurality of wires 64*a* are arranged at intervals. As a result, the mesh portion 64 includes the plurality of openings 64*c* in a grid pattern. The material of the wires 64*a*, 64*b* is not particularly limited as long as the wires 64*a*, 64*b* have corrosion resistance to the plating solution L. Examples of the material of the wires 64*a*, 64*b* may include metal materials such as stainless steel, and resin materials such as polyester.

The mask portion 65 is fixed to a surface facing the substrate B of the surfaces of the mesh portion 64. The mask portion 65 includes a penetrating portion 68 corresponding to the predetermined pattern P. The mask portion 65 is a portion that comes into close contact with the substrate B at the time of film formation by the pressure from the electrolyte membrane 13. The material of the mask portion 65 is not particularly limited as long as the mask portion 65 can be brought into close contact with the substrate B. The mask portion 65 may be compressed and elastically deform by the pressure from the electrolyte membrane 13. Examples of the material of the mask portion 65 may include a resin material such as an acrylic resin, a vinyl acetate resin, a polyvinyl resin, a polyimide resin, or a polyester resin. The screen mask 62 having the predetermined pattern P can be manufactured by a general silk screen manufacturing technique using an emulsion. Therefore, a detailed description of a method of manufacturing the screen mask 62 will be omitted.

The frame 61 supports a peripheral edge 64*d* of the screen mask 62 on the side adjacent to the substrate B (the mount base 40). Specifically, the peripheral edge 64*d* of the screen mask 62 is fixed to the frame 61. In the present embodiment, the screen mask 62 has a rectangular outer shape. Accordingly, the frame 61 has a rectangular frame-like shape. The material of the frame 61 is not particularly limited as long as the frame 61 can retain the shape of the mask structure 60. Examples of the material of the frame 61 may include a metal material such as stainless steel, or a resin material such as a thermoplastic resin. The frame 61 is formed by punching a metallic plate, for example, and has a thickness of about 1 mm to 3 mm. Note that, for convenience of explanation, the thickness of the frame 61 is drawn to be thicker than the actual thickness in FIG. 3A and the like.

The cushion member 30 is disposed along an outer edge portion Bc of the substrate B when the substrate B is pressed. The outer edge portion Bc is an edge (edge portion) formed by the opposite surface Ba of the substrate B facing the screen mask 62 and the side surface Bb of the substrate B.

Here, "the cushion member is disposed along the outer edge portion" as used herein may refer to the following cases (1) to (3). Specifically, in the case (1), the cushion member 30 is disposed along the outer edge portion Bc of the substrate B from the opposite surface Ba of the substrate B. The present embodiment and Modifications 1 to 3 described later correspond to the case (1). In addition, in the case (2), the cushion member 30 is disposed along the outer edge portion Bc of the substrate B from the side surface Bb. Modification 6 and Modification 7 described later correspond to the case (2). The case (3) includes the case (1) and the case (2). Modifications 4 and 5 described later correspond to the case (3).

As shown in FIG. 2 and FIG. 3A, the cushion member 30 is disposed along the outer edge portion Bc of the substrate B. The cushion member 30 includes a rectangular opening 31. The penetrating portion 68 corresponding to the predetermined pattern P is disposed inside the opening 31. When the substrate B is placed on the mount base 40, a gap S is formed between the side surface Bb of the substrate B and a side wall surface 41*a* of the first recess 41. The cushion member 30 is sized to cover the gap S. Specifically, the cushion member 30 is disposed so as to be laid across the opposite surface Ba of the substrate B and the surface (opposite surface) 40*c* of the mount base 40.

The cushion member 30 is made of an elastic material softer than the material of the substrate B. The material of the cushion member 30 is not particularly limited as long as damage to the screen mask 62 can be avoided. The cushion member 30 may be compressed and elastically deform by the pressure from the electrolyte membrane 13 (specifically, by the pressing of the cushion member 30). For example, the material of the cushion member 30 may be a rubber material such as silicone rubber (PMDS) or ethylene propylene diene rubber (EPDM). The hardness of the rubber material may be HS100 or less, specifically HS50 or less, in Shore A hardness. The "soft elastic material" is, for example, a material having a relatively low hardness measured by a hardness meter of a predetermined standard, and is a material having a low Young's modulus by a tensile test. In view of the adhesion between the mask portion 65 and the substrate B, the thickness of the cushion member 30 may be thinner than the thickness of the screen mask. The cushion member 30 may be made of a material softer than the material of the mask portion 65.

Figure 5A:
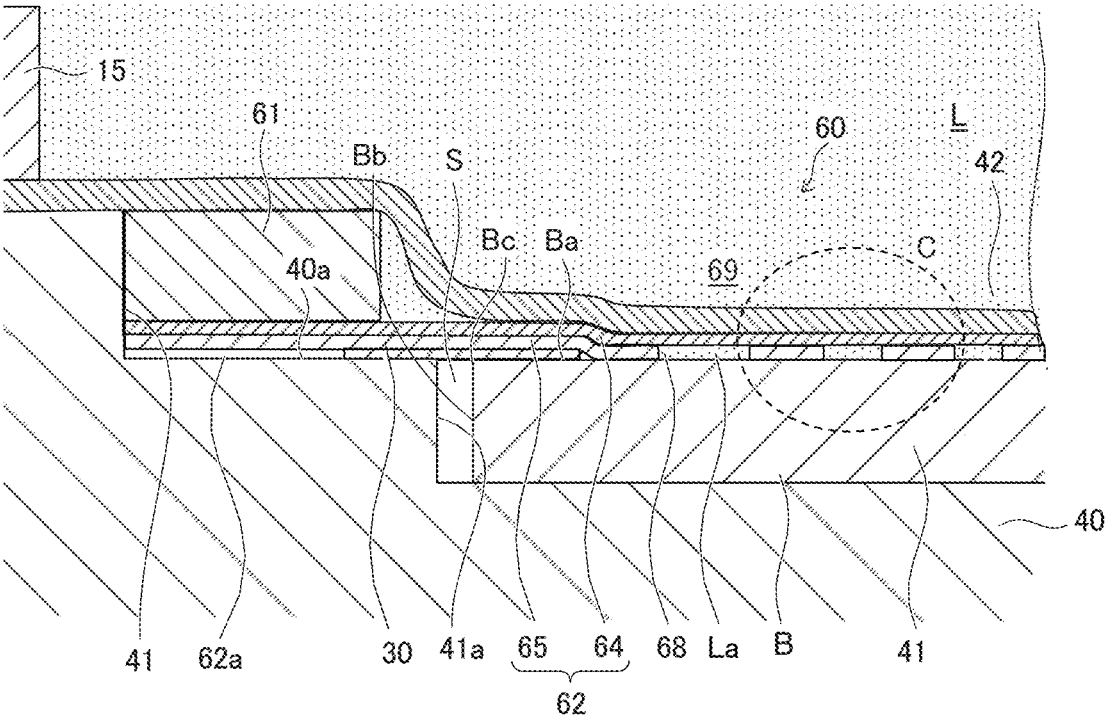
FIG. 5A is a cross-sectional view of a main portion of FIG. 4.
Figure 5B:
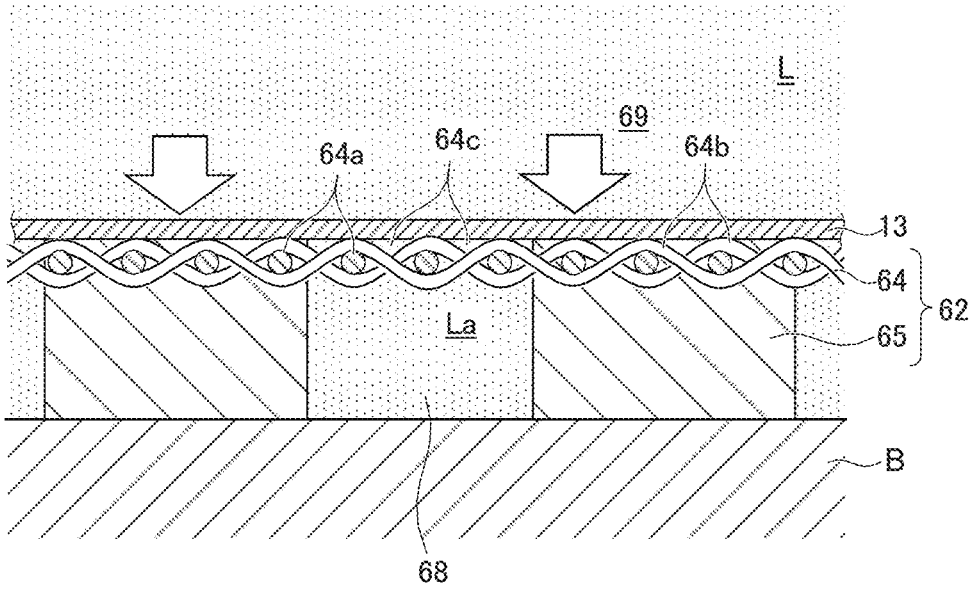
FIG. 5B is an enlarged cross-sectional view of a portion C of FIG. 5A.
Figure 6:
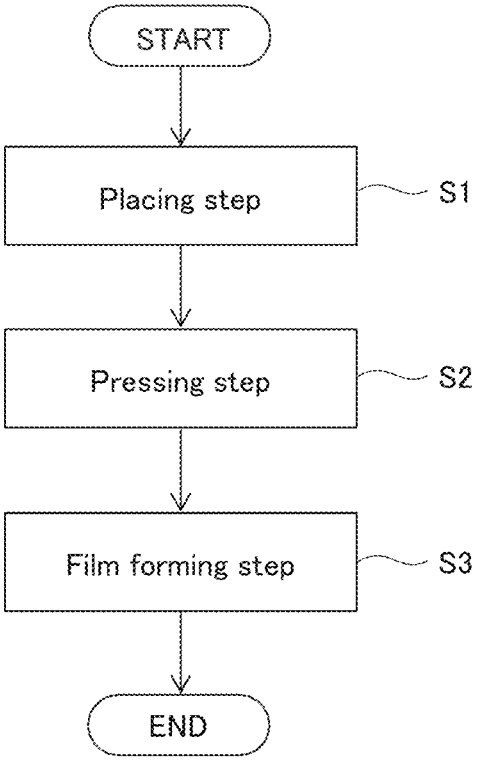
FIG. 6 is a flow chart for explaining an example of a film forming method for forming a metal film using the film forming apparatus according to the embodiment of the present disclosure.

Referring to FIGS. 1 to 6, a film forming method using the film forming apparatus 1 will be described. First, as shown in FIG. 6, a placing step S1 is performed. In this step, the substrate B is placed on the mount base 40. Specifically, the substrate B is housed in the first recess 41 of the mount base 40. At this time, the alignment of the substrate B with respect to the anode 11 attached to the housing 15 may be adjusted, and the temperature of the substrate B may be adjusted.

At this time, as shown in FIG. 3A, a gap S is formed between the side surface Bb of the substrate B and the side wall surface 41*a* of the first recess 41. Therefore, in the placing step S1, as shown in FIG. 1 and FIG. 3A, the cushion member 30 is disposed along the outer edge portion Bc of the substrate B. Specifically, the cushion member 30 covers the gap S from the screen mask 62 side (the electrolyte membrane 13 side).

Next, the mask structure 60 is housed in the second recess 42 of the mount base 40, and the substrate B is covered with the screen mask 62. The cushion member 30 is sandwiched between the screen mask 62 and the opposite surface Ba of the substrate B. The cushion member 30 is also sandwiched between the screen mask 62 and the opposite surface 40*a* of the mount base 40.

Next, a pressing step S2 is performed. In this step, the substrate B is pressed by the electrolyte membrane 13 with the fluid pressure of the plating solution L contacting the electrolyte membrane 13, via the screen mask 62. First, the linear motion actuator 70 is driven. Accordingly, the housing 15 is lowered toward the mask structure 60 from the state of FIG. 1 to the state shown in FIG. 4.

Next, the pump 80 is driven. As a result, the plating solution L is supplied to the storage space 15*a* of the housing 15. Since the pressure regulating valve 54 is provided in the liquid discharge pipe 52, the fluid pressure of the plating solution L in the storage space 15*a* is maintained at a predetermined pressure. Consequently, as shown in FIG. 4, the electrolyte membrane 13 deforms with a fluid pressure toward an inner space 69 of the frame 61, and the mask structure 60 can be sandwiched between the electrolyte membrane 13 and the substrate B. Furthermore, the mask structure 60 can be pressed by the electrolyte membrane 13 on which the fluid pressure of the plating solution L is acting.

Here, as shown in FIG. 4 and FIG. 5A, the peripheral edge 62*a* of the screen mask 62 is supported by the frame 61 on the side adjacent to the substrate B. Therefore, the pressing can bring the screen mask 62 into close contact with the surface of the substrate B. When the mask portion 65 is formed of a rubber material, the mask portion 65 is compressed and elastically deforms with the fluid pressure of the plating solution L, thereby improving the adhesion between the mask portion 65 and the substrate B.

Further, when the pressing of the electrolyte membrane 13 is continued, as shown in FIG. 5A and FIG. 5B, the penetrating portion 68 formed in the screen mask 62 is filled with an exudation solution (plating solution) La exuded from the electrolyte membrane 13 swollen by the plating solution L.

In the present embodiment, the cushion member 30 is disposed along the outer edge portion Bc of the substrate B before pressing the substrate B. Thus, when the substrate B is pressed by the electrolyte membrane 13 with the fluid pressure of the plating solution L via the screen mask 62, the outer edge portion Bc of the substrate B is pressed by the screen mask 62 via the cushion member 30. The cushion member 30 elastically deforms in the thickness direction and absorbs the pressing force of the screen mask 62. Consequently, the outer edge portion Bc of the substrate B can prevent the stress from being focused on the screen mask 62, and damage to the screen mask 62 can be suppressed.

In particular, a gap S may be formed between the substrate B and the mount base 40 while the substrate B is housed in the first recess 41. With this gap S formed, the screen mask 62 easily enters the gap S when the electrolyte membrane 13 presses the substrate B via the screen mask 62. Consequently, the screen mask 62 contacts the opening edge of the first recess 41, and the screen mask 62 is easily damaged. However, by covering the gap S with the cushion member 30, it is possible to prevent the screen mask 62 from entering the gap S. Consequently, damage to the screen mask 62 can be suppressed.

Next, a film forming step S3 is performed. In this step, a metal film F is formed while the pressing state by the electrolyte membrane 13 in the pressing step S2 is maintained. Specifically, a voltage is applied between the anode 11 and the substrate B. This allows metal ions contained in the plating solution L to pass through the electrolyte membrane 13. The metal ions passed through the electrolyte membrane 13 move through the exudation solution La to the surface of the substrate B, and the metal ions are reduced at the surface of the substrate B. Since the exudation solution La filled in the penetrating portion 68 is sealed inside the penetrating portion 68 by the electrolyte membrane 13, the metal film F having the predetermined pattern can be formed on the surface of the substrate B (see FIG. 2). The metal film F is a membrane derived from metal ions.

Furthermore, since the exudation solution La is uniformly pressurized by the pressing of the electrolyte membrane 13, it is possible to form a homogeneous metal film F. After film formation, the plating solution L in the housing 15 is removed and the housing 15 is raised, such that the electrolyte membrane 13 is separated from the substrate B and the substrate B is pulled away from the mount case 40. In manufacturing a wiring pattern using the metal film F, a conductive underlayer formed on the surface of the insulating substrate B may be etched.

<Modifications>

Figure 7A:
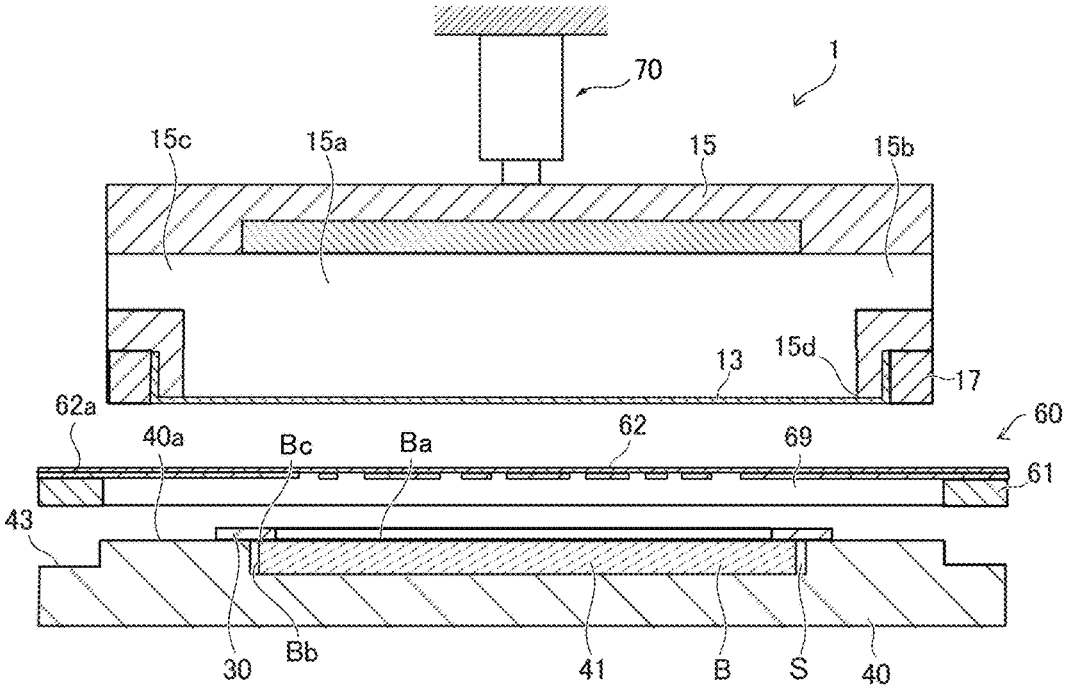
FIG. 7A is a schematic cross-sectional view of the film forming apparatus used in the film forming method according to Modification 1.
Figure 7B:
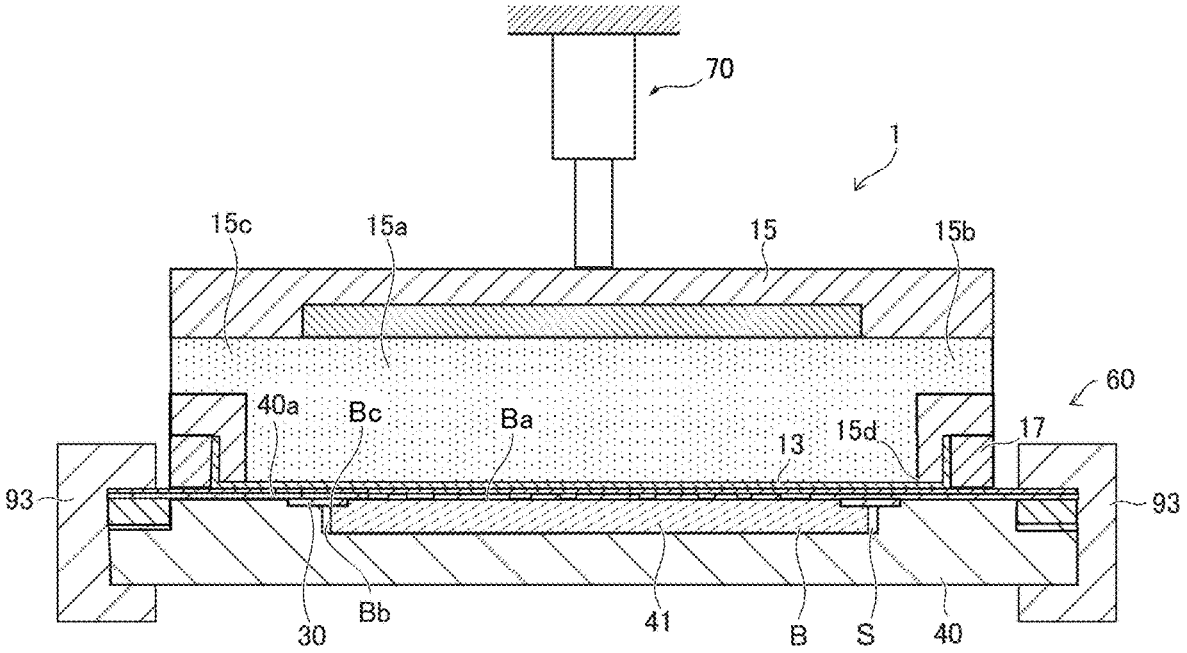
FIG. 7B is a schematic cross-sectional view for explaining the film forming method using the film forming apparatus shown in FIG. 7A.

FIG. 7A is a schematic cross-sectional view of the film forming apparatus used in the film forming method according to Modification 1. FIG. 7B is a schematic cross-sectional view for explaining the film forming method using the film forming apparatus shown in FIG. 7A. Modification 1 differs from the embodiment shown in FIG. 1 and FIG. 4 in the structure of the mask structure 60 and the structure of the mount base 40. Therefore, differences from the above-described embodiment will be described, and the detailed description of the same configuration will be omitted.

As shown in FIG. 7A, the peripheral edge 62*a* of the screen mask 62 is fixed to the frame 61 on the side adjacent to the electrolyte membrane 13. Therefore, the inner space 69 of the frame 61 is open toward the mount base 40. The screen mask 62 is larger than that of the above-described embodiment and also covers the opposite surface 40*a* of the mount base 40. However, the part of the screen mask 62 that contacts the opposite surface 40*a* of the mount base 40 does not include the penetrating portion 68. The mount base 40 includes a recess groove 43 for housing the frame 61. However, in Modification 1, the second recess 42 that houses the mask structure 60 is not formed in the mount base 40.

Hereinafter, the film forming method using the film forming apparatus 1 will be described. First, in the placing step S1, the substrate B is placed on the mount base 40. Specifically, the substrate B is housed in the first recess 41 of the mount base 40. Next, the cushion member 30 is disposed along the outer edge portion Bc of the substrate B. Specifically, the cushion member 30 covers the gap S from the screen mask 62 side (the electrolyte membrane 13 side). The substrate B is then covered with the screen mask 62. At this time, the frame 61 of the mask structure 60 is housed in the recess groove 43 of the mount base 40. Further, as shown in FIG. 7B, the frame 61 and the mount base 40 are sandwiched between dampers 93. Thereafter, similarly, the pressing step S2 and the film forming step S3 are performed.

In Modification 1 as well, as described above, damage to the screen mask 62 can be suppressed by the cushion member 30. In this Modification 1, the peripheral edge of the screen mask 62 is supported by the frame 61 on the side adjacent to the electrolyte membrane 13. Therefore, as shown in FIG. 7B, the screen mask 62 can be pressed by the electrolyte membrane 13 while suppressing the deformation of the electrolyte membrane 13 due to the fluid pressure of the plating solution L. Furthermore, in the frame 61, since the screen mask 62 covers the substrate B, the deformation of the screen mask 62 caused by the pressure from the electrolyte membrane 13 can be suppressed.

Figure 8A:
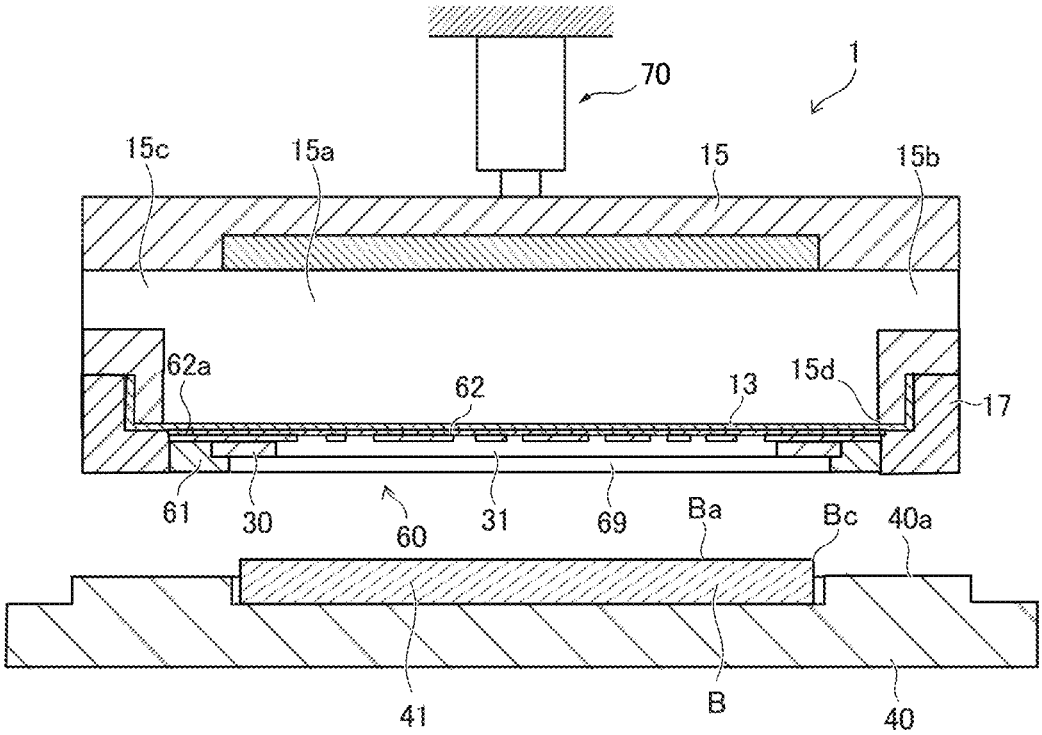
FIG. 8A is a schematic cross-sectional view of the film forming apparatus used in the film forming method according to Modification 2.
Figure 8B:
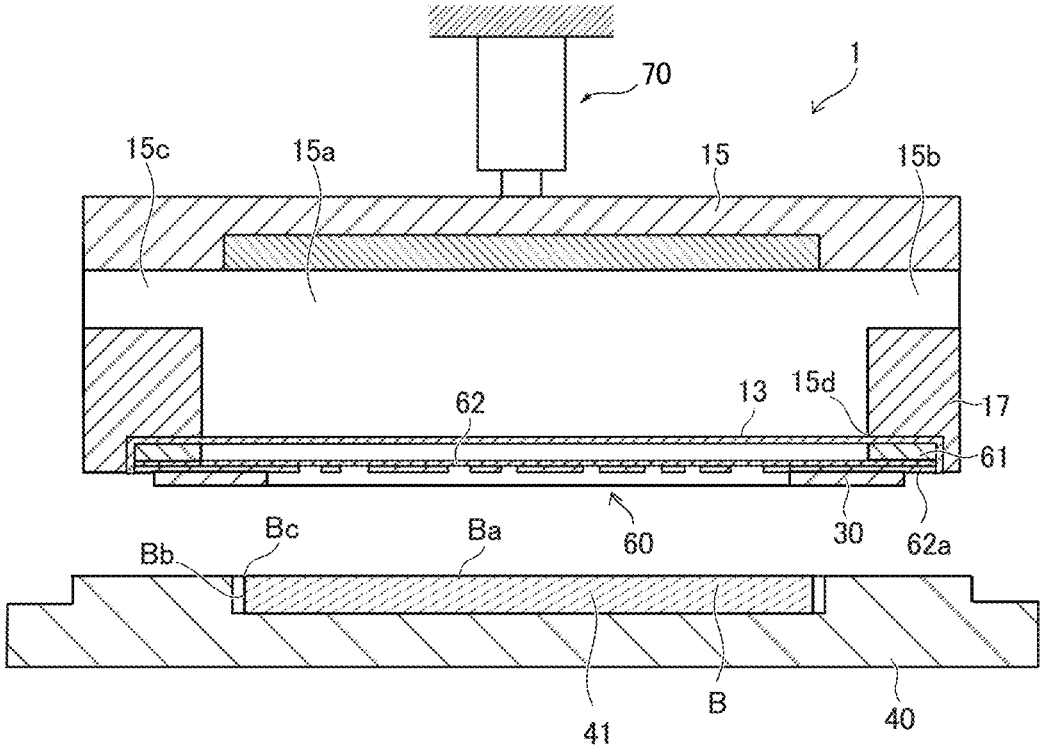
FIG. 8B is a schematic cross-sectional view of the film forming apparatus used in the film forming method according to Modification 3.

FIG. 8A and FIG. 8B are schematic cross-sectional views of the film forming apparatus used in the film forming method according to Modification 2 and Modification 3. In these modifications, the cushion member 30 is attached to the screen mask 62 of the mask structure 60. Differences from the above-described embodiment will be described, and the detailed description of the same configuration will be omitted.

As shown in FIG. 8A, in Modification 2, the mask structure 60 is attached to the frame 17 of the housing 15. The peripheral edge 62*a* of the screen mask 62 is fixed to the frame 61 on the side adjacent to the electrolyte membrane 13. Thus, the inner space 69 of the frame 61 is open to the mount base 40 (on the substrate B side). The cushion member 30 is attached to the screen mask 62. With the substrate B housed in the first recess 41, the opposite surface Ba of the substrate B protrudes from the opposite surface 40*a* of the mount base 40. As a result, the screen mask 62 can be uniformly brought into contact with the opposite surface Ba of the substrate B.

As shown in FIG. 8B, in this Modification 3, the mask structure 60 is attached to the frame 17 of the housing 15. The peripheral edge 62*a* of the screen mask 62 is fixed to the frame 61 on the side adjacent to the mount base 40 (the substrate B). In this modification, the electrolyte membrane 13 is attached to the housing 15 via the frame 61. Specifically, the peripheral edge of the electrolyte membrane 13 is sandwiched between the frame 61 and the housing 15. Thus, when the frame 61 is attached to the housing 15, the electrolyte membrane 13 can also be attached to the housing 15. However, as in the above-described embodiment, the electrolyte membrane 13 may be attached to the housing 15 using the frame 17. The cushion member 30 is attached to the screen mask 62 on the side adjacent to the mount base 40. In Modification 3, the electrolyte membrane 13 is deformed toward the inner space 69 of the frame 61 with the fluid pressure of the plating solution L.

Hereinafter, the film forming method using the film forming apparatus 1 according to Modification 2 and Modification 3 will be described. First, in the placing step S1, the substrate B is placed on the mount base 40. Specifically, the substrate B is housed in the first recess 41 of the mount base 40. In these modifications, the housing 15 is then lowered. Thus, the screen mask 62 covers the substrate B. At this time, the cushion member 30 is attached to the screen mask 62. Thus, the screen mask 62 can cover the opposite surface Ba of the substrate B and the cushion member 30 can cover the gap S. Further, since the cushion member 30 is attached to the screen mask 62 in advance, it is possible to prevent misalignment of the cushion member 30 with respect to the screen mask 62.

In Modification 2, the electrolyte membrane 13 is hardly deformed with the fluid pressure of the plating solution L. As a result, it is possible to suppress sagging or the like of the electrolyte membrane 13 due to repeated use.

Figure 9A:
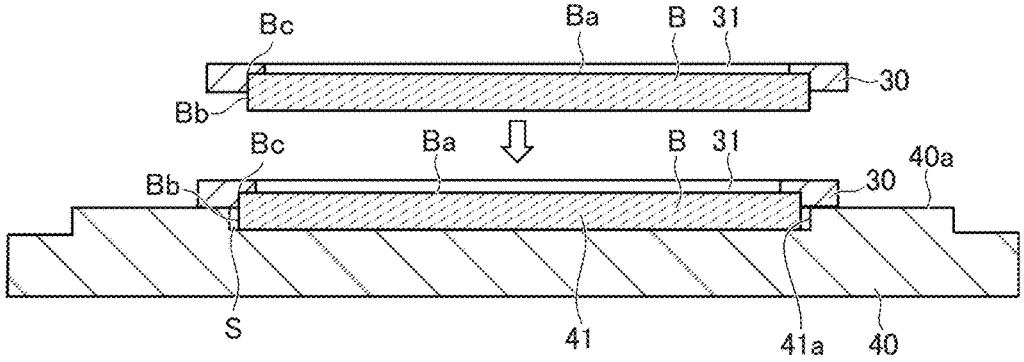
FIG. 9A is a schematic cross-sectional view for explaining the cushion member used in the film forming method according to Modification 4.
Figure 9B:
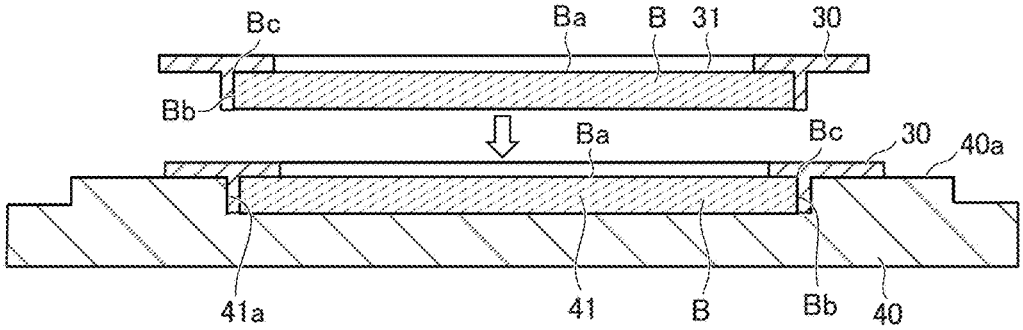
FIG. 9B is a schematic cross-sectional view for explaining the cushion member used in the film forming method according to Modification 5.

FIG. 9A and FIG. 9B are schematic cross-sectional views for explaining the cushion member used in the film forming method according to Modification 4 and Modification 5. In these modifications, the cushion member 30 is attached to the substrate B. Differences from the above-described embodiment will be described, and the detailed description of the same configuration will be omitted.

As shown in FIG. 9A, in Modification 4, the cushion member 30 is attached to the outer edge portion Bc of the substrate B. Specifically, a portion of the opposite surface Ba of the substrate B and a portion of the side surface Bb of the substrate B are covered with the cushion member 30.

The mount base 40 includes the first recess 41 for housing the substrate B. Similar to the embodiment shown in FIG. 1, the mount base 40 may include the second recess for housing the mask structure 60. With the substrate B housed in the first recess 41, the cushion member 30 covers the gap S formed between the side surface Bb of the substrate B and the side wall surface 41*a* of the first recess 41. In Modification 4, with the substrate B housed in the first recess 41, the opposite surface Ba of the substrate B protrudes from the opposite surface 40*a* of the mount base 40. As a result, the screen mask 62 can be uniformly brought into contact with the opposite surface Ba of the substrate B.

On the other hand, as shown in FIG. 9B, also in Modification 5, the cushion member 30 is attached to the outer edge portion Bc of the substrate B. Specifically, a portion of the opposite surface Ba of the substrate B and the side surface Bb of the substrate B are covered with the cushion member 30. With the substrate B housed in the first recess 41, the opposite surface 40*a* of the mount base 40 is covered with a portion of the cushion member 30. Further, a portion of the cushion member 30 enters the gap formed between the side surface Bb of the substrate B and the side wall surface 41*a* of the first recess 41.

Hereinafter, the film forming method using the film forming apparatus 1 according to Modification 4 and Modification 5 will be described. First, in the placing step S1, prior to placing the substrate B on the mount base 40, the cushion member 30 is attached to the substrate B along the outer edge portion Bc of the substrate B. As shown in FIG. 9A, in Modification 4, by attaching the cushion member 30 to the substrate B, the opposite surface Ba of the substrate B and the side surface Bb of the substrate B along the outer edge portion Bc of the substrate B are covered with the cushion member 30. The cushion member 30 is disposed so as to cover the gap S with the substrate B housed in the first recess 41 of the mount base 40.

Further, as shown in FIG. 9B, in Modification 5, the cushion member 30 is attached to the substrate B such that the cushion member 30 covers the opposite surface Ba of the substrate B and the side surface Bb of the substrate B along the outer edge portion Bc of the substrate B. Next, when the substrate B is placed, the substrate B is housed in the first recess 41 while sandwiching the cushion member 30 between the side wall surface 41*a* of the first recess 41 and the side surface Bb of the substrate B. Elastic deformation of the sandwiched cushion member 30 allows the substrate B to be secured to the mount base 40.

As described above, in Modification 4, since the gap S can be covered with the cushion member 30, the screen mask 62 can be prevented from being damaged. In Modification 5, since there is no gap between the substrate B and the mount base 40, the screen mask 62 can be prevented from being damaged.

In these modifications, the substrate B can be placed on the mount base 40 with the cushion member 30 attached to the substrate B. Therefore, when the substrate B is placed, the cushion member 30 can be disposed at the same time to prevent misalignment of the cushion member 30 with respect to the substrate B. Further, in Modification 5, the cushion member 30 is sandwiched between the side wall surface 41*a* of the first recess 41 and the side surface Bb of the substrate B. Consequently, it is possible to prevent misalignment of the substrate with respect to the mount base 40.

Figure 10A:
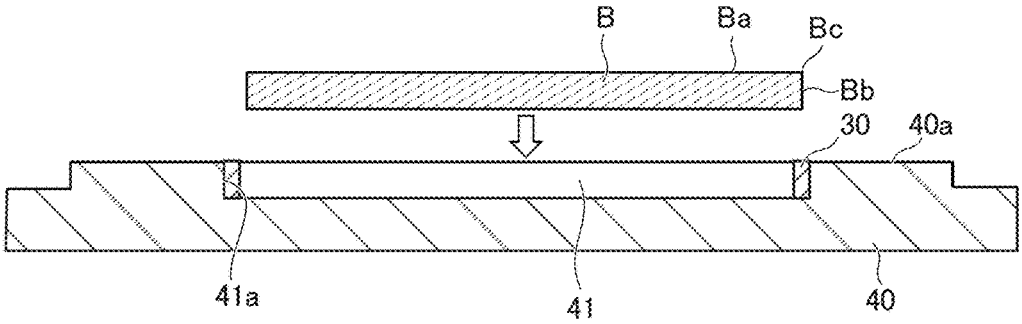
FIG. 10A is a schematic cross-sectional view for explaining the cushion member used in the film forming method according to Modification 6.
Figure 10B:
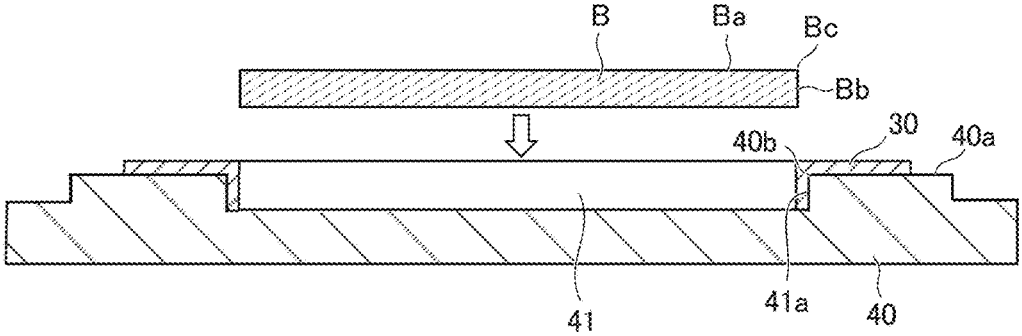
FIG. 10B is a schematic cross-sectional view for explaining the cushion member used in the film forming method according to Modification 7.

FIG. 10A and FIG. 10B are schematic cross-sectional views for explaining the cushion member used in the film forming method according to Modification 6 and Modification 7. In these modifications, the cushion member 30 is attached to the mount base 40. Differences from the above-described embodiment will be described, and the detailed description of the same configuration will be omitted.

As shown in FIG. 10A and FIG. 10B, in Modification 6 and Modification 7, the mount base 40 includes the first recess 41 for housing the substrate B. Similar to the embodiment shown in FIG. 1, the mount base 40 may include a second recess for housing the mask structure 60.

In Modification 6 and Modification 7, the cushion member 30 is attached to the side wall surface 41*a* of the first recess 41. Specifically, as shown in FIG. 10, in Modification 6, the side wall surface 41*a* of the first recess 41 is covered with the cushion member 30. The cushion member 30 may protrude from the opposite surface Ba of the substrate B and the opposite surface 40*a* of the mount base 40 with the substrate B housed in the first recess 41. As shown in FIG.

10B, in Modification 7, the cushion member 30 is attached along the opening edge 41*b* of the first recess 41. Specifically, the side wall surface 41*a* of the first recess 41 and the opposite surface 40*a* of the mount base 40 are covered with the cushion member 30.

Hereinafter, the film forming method using the film forming apparatus 1 according to Modification 6 and Modification 7 will be described. First, in the placing step S1, the cushion member 30 is attached to the mount base 40 prior to placing the substrate B on the mount base 40. In these modifications, when the substrate B is placed, the substrate B is housed in the first recess 41 while sandwiching the cushion member 30 between the side wall surface 41*a* of the first recess 41 and the side surface Bb of the substrate B. Elastic deformation of the sandwiched cushion member 30 allows the substrate B to be secured to the mount base 40.

Further, in these modifications, by attaching the cushion member 30 to the side wall surface 41*a* of the mount base 40, the substrate B can be covered with the cushion member 30 from the side surface Bb of the substrate B along the outer edge portion Bc of the substrate B. Furthermore, since there is no gap S between the side surface Bb of the substrate B and the side wall surface 41*a* of the mount base 40, the screen mask 62 will not enter the gap. Consequently, the screen mask 62 can be prevented from being damaged.

In these modifications, when the substrate B is placed, the cushion member 30 can be disposed at the same time on the substrate B. Furthermore, it is possible to prevent misalignment of the cushion member 30 with respect to the substrate B and to prevent misalignment of the substrate B with respect to the mount base 40.

EXAMPLES

The present disclosure will be described by the following examples.

Example

As the substrate for film formation, a glass epoxy substrate was prepared by impregnating a pile of glass fiber fabric with an epoxy resin. A copper foil was formed on the surface of the glass epoxy substrate. Next, a copper film was formed using the film forming apparatus according to the modification shown in FIG. 7A. For the cushion member, a silicone rubber (Shore A hardness HS50) having a thickness of 0.1 mm was used. As the plating solution, a copper sulfate aqueous solution (Cu-BRITE-SED) manufactured by JCU Corporation was used, and as an anode, a Cu plate was used. Nafion (registered trademark) available from DuPont was used for the electrolyte membrane. A copper film was formed under the electric film formation conditions including: a temperature of the plating solution of 42° C., a current density of 7 A/dm$^2$, and a cumulative pressing time of 500 seconds. Film formation was performed under two conditions: fluid pressures of 0.6 MPa and 1 MPa of the plating solution.

Comparative Example

A copper film was formed in the same manner as in Example. The difference from Example was that the cushion member was not used.

Conditions of the electrolyte membranes according to the film forming apparatus of Example and the film forming apparatus of Comparative Example after film formation were checked. In both conditions of the two fluid pressures, the screen mask according to Example was not damaged. On the other hand, in both conditions of the two fluid pressures, the screen mask according to Comparative Example was broken.

While the embodiment of the present disclosure has been described above, the present disclosure is not limited to the film forming apparatus according to the above-described embodiment, and includes all aspects included in the concepts of the present disclosure and the claims. In addition, each configuration may be selectively combined as appropriate so as to achieve the above-described problems to be solved and effects. For example, shapes, materials, arrangements, sizes, and the like of the constituent elements in the above-described embodiment may be appropriately changed according to specific aspects of the present disclosure.

What is claimed is:

1. A film forming method for forming a metal film, comprising:

placing a substrate on a mount base;

covering the substrate with a screen mask including a penetrating portion of a predetermined pattern;

pressing the substrate by an electrolyte membrane with a fluid pressure of a plating solution contacting the electrolyte membrane via the screen mask; and applying a voltage between an anode contacting the plating solution and the substrate so as to allow metal ions contained in the plating solution to pass through the electrolyte membrane and form a metal film derived from the metal ions in the predetermined pattern on the substrate, wherein:

the substrate includes an outer edge portion formed by an opposite surface facing the screen mask and a side surface, the screen mask includes a mesh portion in which openings are formed in a grid pattern, and a mask portion including the penetrating portion, the mask portion being fixed to the mesh portion so as to face the substrate, and a peripheral edge of the screen mask is fixed to a frame, and the screen mask is stretched at a predetermined tension so as to cover an opening of the frame, wherein:

in placing the substrate, the substrate is housed in a recess of the mount base, and before pressing the substrate, a cushion member is disposed along the outer edge portion between the screen mask and the substrate and between the screen mask and the mount base, so as to be laid across the mount base and the substrate and to cover a gap formed between the side surface of the substrate and a side wall surface of the recess, and wherein:

the cushion member is made of a material softer than a material of the mask portion.

2. The film forming method for forming a metal film according to claim 1, wherein before placing the substrate, the cushion member is attached to the substrate along the outer edge portion.

3. The film forming method for forming a metal film according to claim 2, wherein:

the cushion member further includes an entering portion configured to enter the gap during formation of the metal film, before placing the substrate, the entering portion covers the side surface of the substrate by attaching the cushion member to the substrate, and in placing the substrate, the substrate is housed in the recess while sandwiching the entering portion between the side wall surface of the recess and the side surface of the substrate.

4. The film forming method for forming a metal film according to claim 1, wherein:

a peripheral edge of the screen mask is fixed to the frame on a side adjacent to the substrate.

5. The film forming method for forming a metal film according to claim 3, wherein, in placing the substrate in the recess, the entering portion is elastically compressed and deformed between the side wall surface of the recess and the side surface of the substrate.

* * * * *